US007343938B2

(12) United States Patent
Takimoto

(10) Patent No.: US 7,343,938 B2
(45) Date of Patent: Mar. 18, 2008

(54) INDUSTRIAL TWO-LAYER FABRIC

(75) Inventor: Keiichi Takimoto, Shizuoka (JP)

(73) Assignee: Nippon Filcon Co. Ltd., Tokyo (JP)

( * ) Notice: Subject to any disclaimer, the term of this patent is extended or adjusted under 35 U.S.C. 154(b) by 182 days.

(21) Appl. No.: 11/207,939

(22) Filed: Aug. 22, 2005

(65) Prior Publication Data

US 2006/0048838 A1 Mar. 9, 2006

(30) Foreign Application Priority Data

Aug. 23, 2004 (JP) ..... 2004-242240

(51) Int. Cl.
*D21F 7/08* (2006.01)
*D03D 25/00* (2006.01)
*D21F 7/10* (2006.01)

(52) U.S. Cl. ..... 139/383 A; 139/383 AA

(58) Field of Classification Search ..... 139/383 A, 139/383 AA

See application file for complete search history.

(56) References Cited

U.S. PATENT DOCUMENTS 4,564,051 A 1/1986 Odenthal et al.
4,821,780 A * 4/1989 Tate ..... 139/383 A
4,974,642 A * 12/1990 Taipale ..... 139/383 A
4,998,569 A * 3/1991 Tate ..... 139/383 A
5,022,441 A * 6/1991 Tate et al. ..... 139/383 A
5,103,875 A * 4/1992 Tate et al. ..... 139/383 A
5,117,542 A * 6/1992 Krenkel et al. ..... 28/141
5,254,398 A * 10/1993 Gaisser ..... 442/195
5,379,808 A * 1/1995 Chiu ..... 139/383 A
5,456,293 A * 10/1995 Ostermayer et al. .... 139/383 A
5,542,455 A * 8/1996 Ostermayer et al. .... 139/383 A
5,713,397 A * 2/1998 Quigley ..... 139/383 A
5,829,489 A * 11/1998 Kuji ..... 139/383 A
6,202,705 B1 * 3/2001 Johnson et al. ..... 139/383 A
6,860,299 B2 * 3/2005 Kuji ..... 139/383 A
7,001,489 B2 * 2/2006 Taipale et al. ..... 162/348
7,059,357 B2 * 6/2006 Ward ..... 139/348
7,073,539 B2 * 7/2006 Takimoto et al. ..... 139/383 A
2006/0048838 A1 * 3/2006 Takimoto ..... 139/383 A

OTHER PUBLICATIONS

European Search Report dated Oct. 2, 2006.

* cited by examiner

*Primary Examiner*—Robert H Muromoto
(74) *Attorney, Agent, or Firm*—Rader, Fishman & Grauer PLLC

(57) ABSTRACT

An industrial two-layer fabric comprising pairs of an upper surface side warp and a lower surface side warp arranged vertically, and warp binding yarns woven with upper surface side wefts and lower surface side wefts to form a portion of an upper surface side surface design and a portion of a lower surface side surface design. Upper surface side warps and warp binding yarns are of the same diameter and lower surface side warps have a greater diameter than warp binding yarns and upper surface side warps. A lower surface side layer is designed so that lower surface side warps and warp binding yarns are arranged alternately, and one lower surface side weft passes over one lower surface side warp and one warp binding yarn adjacent to each other, and passes under a plurality of lower surface side warps and warp binding yarns.

8 Claims, 9 Drawing Sheets

INDUSTRIAL TWO-LAYER FABRIC

TECHNICAL FIELD OF THE INVENTION

The present invention relates to an industrial two-layer fabric used for transport, dehydration and the like, particularly suited for papermaking.

BACKGROUND ART

Fabrics obtained by weaving warps and wefts have conventionally been used widely as an industrial fabric. They are, for example, used in various fields including papermaking wires, conveyor belts and filter cloths and are required to have fabric properties suited for the intended use or using environment. Of such fabrics, a papermaking wire used in a papermaking step for removing water from raw materials by making use of the network of the fabric must satisfy a severe demand. There is therefore a demand for the development of fabrics which do not transfer a wire mark of the fabric and therefore have excellent surface property, have enough rigidity and therefore are usable desirably even under severe environments, or are capable of maintaining conditions necessary for making good paper for a prolonged period of time. In addition, fiber supporting property, improvement in a papermaking yield, good water drainage property, wear resistance, dimensional stability and running stability are demanded. In recent years, owing to the speed-up of a papermaking machine, requirements for papermaking wires become severe further.

Since most of the demands for industrial fabrics and solutions thereof can be understood if papermaking fabrics on which the most severe demand is imposed among industrial fabrics will be described, the present invention will hereinafter be described by use of the papermaking fabric as a representative example.

For papermaking fabrics, excellent surface property not permitting transfer of wire marks of the fabric to paper and wear resistance enough to be resistant against abrasion caused by the contact with a machine during operation are very important. Research has been made to develop fabrics capable of satisfying the above-described properties. Recently, two-layer fabrics using a warp binding yarn which is woven with an upper surface side weft and a lower surface side weft to form both a portion of an upper surface side surface design and a portion of a lower surface side surface design and at the same time, has a binding function has come to be used. A two-layer fabric using a warp binding yarn is also disclosed in Japanese Patent Laid-Open No. 2004-52188.

SUMMARY OF THE INVENTION

This fabric has excellent wear resistance because it adopts a design of forming a long crimp of a lower surface side weft, but it has difficulty in forming an even surface because its warp binding yarn having a relatively small diameter is sometimes worn away and broken owing to a design in which it singly passes under the lower surface side weft and in addition, yarns in the warp direction which form an upper surface side surface are not equal in diameter.

With the foregoing problems in view, the present invention has been made. An object of the present invention is to provide an industrial two-layer fabric having excellent surface property, binding power, rigidity, and wear resistance and usable for a prolong period by forming a dense upper surface side surface by using warps which have an equal and relatively small diameter, and designing a lower surface side layer so that a warp binding yarn of a relatively small diameter weaves therein both a lower surface side warp having a greater diameter than the warp binding yarn and a lower surface side weft, in other words, the lower surface side weft passes over the lower surface side warp and warp binding yarn which are adjacent to each other and then passes under a plurality of lower surface side warps and warp binding yarns, thereby reducing the abrasion of the warp binding yarns of a smaller diameter.

The present invention relates to an industrial two-layer fabric comprising pairs of an upper surface side warp and a lower surface side warp arranged vertically, and warp binding yarns woven with upper surface side wefts and lower surface side wefts to form a portion of an upper surface side surface design and a portion of a lower surface side surface design. Upper surface side warps and warp binding yarns are of the same diameter and lower surface side warps have a greater diameter than warp binding yarns and upper surface side warps. A lower surface side layer is designed so that lower surface side warps and warp binding yarns are arranged alternately, and one lower surface side weft passes over one lower surface side warp and one warp binding yarn adjacent to each other, and passes under a plurality of lower surface side warps and warp binding yarns.

A pair of warp binding yarns may be arranged adjacent to the pair of an upper surface side warp and a lower surface side warp arranged vertically, and on the upper surface side surface, warp binding yarns as the pair may be woven with respective upper surface side wefts and cooperatively function as one warp constituting the upper surface side complete design.

A pair of an upper surface side warp and a warp binding yarn may be arranged adjacent to the pair of a upper surface side warp and a lower surface side warp arranged vertically, and on the upper surface side surface, an upper surface side warp and a warp binding yarn as the pair may be woven with respective upper surface side wefts and cooperatively, function as one warp constituting the upper surface side complete design. One warp binding yarn may pass over at least one upper surface side weft to form the upper surface side surface, below which the other warp binding yarn may be woven with at least one lower surface side weft, and at the same time, one warp binding yarn may be woven with at least one lower surface side weft, over which the other warp binding yarn may pass over at least one upper surface side weft to form the upper surface side surface. The pair of warp binding yarns mutually may complement the upper surface side surface design and lower surface side surface design one another and functions as one warp constituting the upper surface side complete design on the upper surface side and as one warp constituting the lower surface side complete design on the lower surface side.

The upper surface side complete design may be composed of one warp complete design or of at least two warp complete designs. The upper surface side surface design may be any one of 2-shaft plain weave, 4-shaft twill weave, 4-shaft broken twill weave, 8-shaft twill weave and 8-shaft broken twill weave. Further, the number of upper surface side wefts may be 1 to 2 times the number of lower surface side wefts.

In an industrial two-layer fabric comprising pairs of an upper surface side warp and a lower surface side warp arranged vertically, and warp binding yarns woven with upper surface side wefts and lower surface side wefts to form a portion of an upper surface side surface design and a portion of a lower surface side surface design, the diameters of the upper surface side warp and warp binding yarn are made equal; the diameter of the lower surface side warp is made greater than the diameter of each of the warp binding yarn and upper surface wide warp; a lower surface side layer is designed so that a lower surface side warp and warp binding yarn are arranged alternately, a lower surface side weft passes over a lower surface side warp and a warp binding yarn adjacent to each other, and passes under a plurality of lower surface side warps and warp binding yarns. This brings about effects for imparting the industrial two-layer fabric with necessary properties therefor such as surface property, wear resistance, rigidity, fiber supporting property, and running stability.

DETAILED DESCRIPTION OF THE INVENTION

Figure 1:
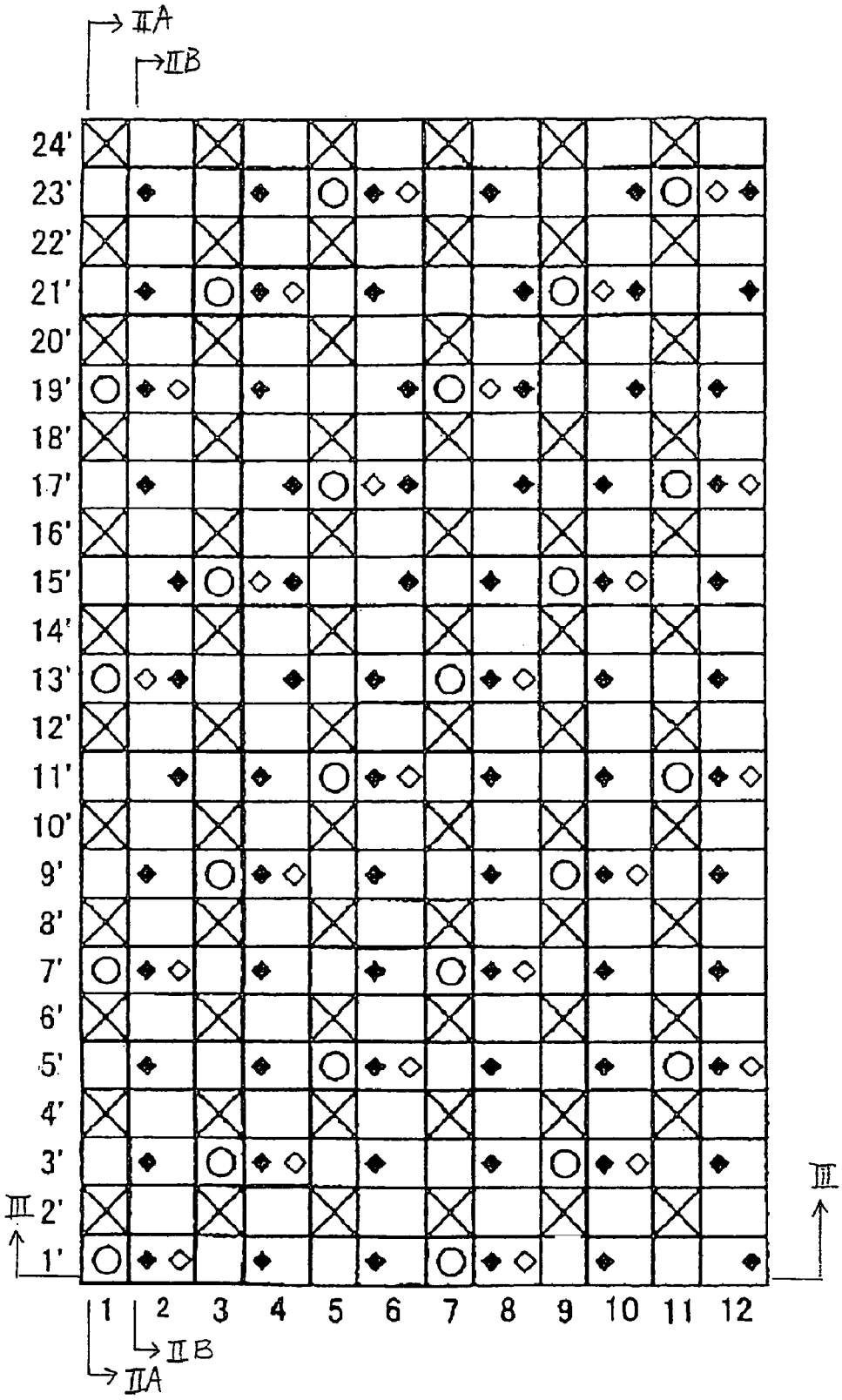
FIG. 1 is a design diagram of an industrial two-layer fabric according to Example 1 of the present invention.

The industrial fabric according to the present invention is an industrial two-layer fabric comprising pairs of an upper surface side warp and a lower surface side warp arranged vertically, and warp binding yarns woven with upper surface side wefts and lower surface side wefts to form a portion of an upper surface side surface design and a portion of a lower surface side surface design. In this fabric, the diameters of the upper surface side warp and warp binding yarn are made equal; the diameter of the lower surface side warp is made greater than the diameter of each of the warp binding yarn and upper surface wide warp; and a lower surface side layer is designed so that a lower surface side warp and a warp binding yarn are arranged alternately, a lower surface side weft passes over a lower surface side warp and a warp binding yarn adjacent to each other, and then passes under a plurality of lower surface side warps and warp binding yarns.

The term "upper surface side complete design" as used herein means a minimum unit of a fabric design constituting an upper surface side surface. By repeating this design, an upper surface side fabric is formed. The term "lower surface side complete design", on the other hand, means a minimum unit of a fabric design constituting a lower surface side surface. By repeating this design, a lower surface side fabric is formed. A warp design constituting the upper surface side complete design is called "an upper surface side warp complete design". The upper surface side complete design is formed by arranging the upper surface side warp complete design while shifting it. The warp complete design may be one kind or at least two kinds. By arranging respective warp complete designs as needed and shifting them successively, the upper surface side complete design is formed. This equally applies to a lower surface side complete design and a lower surface side warp complete design. The fabric according to the present invention has a two-layer structure obtained by weaving an upper surface side layer and a lower surface side layer so that the above-described upper surface side complete design and the lower surface side complete design are combined vertically in combination to form a complete weave pattern. The fabric is formed by repeating this complete weave pattern.

In the industrial two-layer fabric of the present invention, an upper surface side warp and a lower surface side warp are arranged vertically and they form a pair. The upper surface side warp is woven with an upper surface side weft to form an upper surface side layer, while the lower surface side warp is woven with a lower surface side weft to form a lower surface side layer. A warp binding yarn is used as a binding yarn for weaving the upper surface side layer with the lower surface side layer. In the present invention, the warp binding yarn is not arranged singly but is arranged as a pair of two warp binding yarns or as a pair of a warp binding yarn and an upper surface side warp. The two warp binding yarns constituting a pair cooperatively function as one warp for forming an upper surface side complete design on an upper surface side surface, while they cooperatively function as one warp for forming a lower surface side complete design on a lower surface side surface. Thus, the pair of warp binding yarns necessarily forms both of these complete designs. The warp binding yarn and the upper surface side warp constituting the pair cooperatively functions as one warp for forming an upper surface side complete design on an upper surface side surface, while the warp binding yarn functions as one warp for forming a lower surface side complete design on a lower surface side surface. Thus, the pair of the warp binding yarn and the upper surface side warp forms complete designs. The two warp binding yarns forming the par may have the same design or different design. In addition, it is recommended to design the fabric so that the pair of two warp binding yarns is arranged adjacent to the pair of an upper surface side warp and a lower surface side warp arranged vertically; or the pair of an upper surface side warp and a warp binding yarn is arranged adjacent to the pair of an upper surface side warp and a lower surface side warp.

The warp binding yarn is woven with an upper surface side weft and a lower surface side weft to form a portion of the upper surface side surface design and a portion of the lower surface side surface design. On the upper surface side surface, warp binding yarns as a pair, or an upper surface side warp and a warp binding yarn as a pair are woven with respective upper surface side wefts and they cooperatively function as one warp constituting the upper surface side complete design. In order to improve the surface property, a yarn of the same diameter as that of the upper surface side warp is used as the warp binding yarn. Existence of a difference in diameter between the upper surface side warp and the warp binding yarn is not preferred, because a yarn having a larger diameter sometimes protrudes from the upper surface side surface and transfers wire marks to paper. A relatively even surface can be formed if the upper surface side warp and warp binding yarn have the same diameter. In general, yarns of a great diameter tend to be used for production of industrial fabrics in order to improve the wear resistance on the lower surface side which is brought into contact with a machine. Also in the present invention, the diameter of the lower surface side warp is made greater than that of the upper surface side warp. Since the warp binding yarn forms the lower surface side surface as well as the upper surface side surface, use of a yarn having a great diameter is preferred when improvement of its wear resistance is intended. The surface property on the upper surface side is however important in the present invention so that the diameter of the warp binding yarn is made relatively small similar to that of the upper surface side warp. At the same time, yarn arrangement and design specific to the present invention are adopted in the lower surface side layer to improve the wear resistance without lowering the surface property.

In the lower surface side layer, the lower surface side warp and the warp binding layer are arranged alternately, and the lower surface side design is formed so that a lower surface side weft passes over a lower surface side warp and a warp binding yarn adjacent to each other and then passes under a plurality of lower surface side warps and warp binding yarns disposed alternately. In other words, in the lower surface side, a warp binding yarn and a lower surface side warp are always arranged alternately and adjacent to each other so that at a portion where a warp binding yarn passes under a lower surface side weft and appears from the lower surface side surface, the lower surface side warp of a greater diameter adjacent to the warp binding yarn also always appears from the lower surface side surface. The warp binding yarn having a relatively small diameter therefore does not protrude from the lower surface side surface. The lower surface side warp of a greater diameter is responsible for the wear so that the warp binding yarn is protected from the wear. In addition, the warp binding yarn and lower surface side warp adjacent to each other weave therein the lower surface side weft simultaneously so that various physical properties necessary for industrial fabrics such as rigidity and running stability as well as surface property and wear resistance can be obtained.

No particular limitation is imposed on the upper surface side design and warp binding yarns forming a pair are woven with respective upper surface side wefts and they cooperatively function as one warp constituting the upper surface side complete design. Or, an upper surface side warp and a warp binding yarn forming a pair are woven with respective upper surface side wefts and they cooperatively function as one warp constituting the upper surface side complete design. The warp complete design on the upper surface side formed in such a manner and the warp complete design of an upper surface side warp forming a pair with a lower surface side warp may be the same or different. The upper surface side complete design may of course be composed of a plurality of warp complete designs.

Although a yarn to be used in the present invention may be selected depending on its application, examples of it include, in addition to monofilaments, multifilaments, spun yarns, finished yarns obtained by crimping or bulking such as so-called textured yarn, bulky yarn and stretch yarn, and yarns obtained by intertwining them. As the cross-section of the yarn, not only circular form but also square or short form such as stellar form, or elliptical or hollow form can be used. The material of the yarn can be selected freely and usable examples of it include polyester, polyamide, polyphenylene sulfide, polyvinylidene fluoride, polypropylene, aramid, polyether ether ketone, polyethylene naphthalate, polytetrafluoroethylene, cotton, wool and metal. Of course, yarns obtained using copolymers or incorporating or mixing the above-described material with a substance selected depending on the intended purpose may be used.

For upper surface side warps, lower surface side warps, warp binding yarns and upper surface side wefts of a papermaking wire, use of polyester monofilaments having rigidity and excellent size stability are usually preferred. On the other hand, for lower surface side wefts which need wear resistance, use of yarns obtained by interweaving polyester monofilaments with polyamide monofilaments while arranging them alternately are preferred, because it improves wear resistance while maintaining rigidity.

No particular limitation is imposed on the component yarns of the fabric insofar as the upper surface side warp and the warp binding yarn are of the same diameter, and the diameter of the lower surface side warp is greater than it. It is preferred, for example, to adjust the diameter of the upper surface side warp to 0.13 mm, that of the warp binding yarn to 0.13 mm, that of the lower surface side warp to 0.20 mm, that of the upper surface side weft to 0.13 mm and that of the lower surface side weft to 0.25 mm. The diameter can be selected depending on the purpose and for paperboard manufacture, a warp binding yarn and an upper surface side warp each having a diameter of 0.15 mm are used. The diameter of the other yarns may be made greater based on this value. A thread count or the like may be determined depending on the yarn to be used or intended use.

EXAMPLES

Embodiments of the present invention will next be described based on some examples with reference to accompanying drawings.

Figures 2A, 2B:
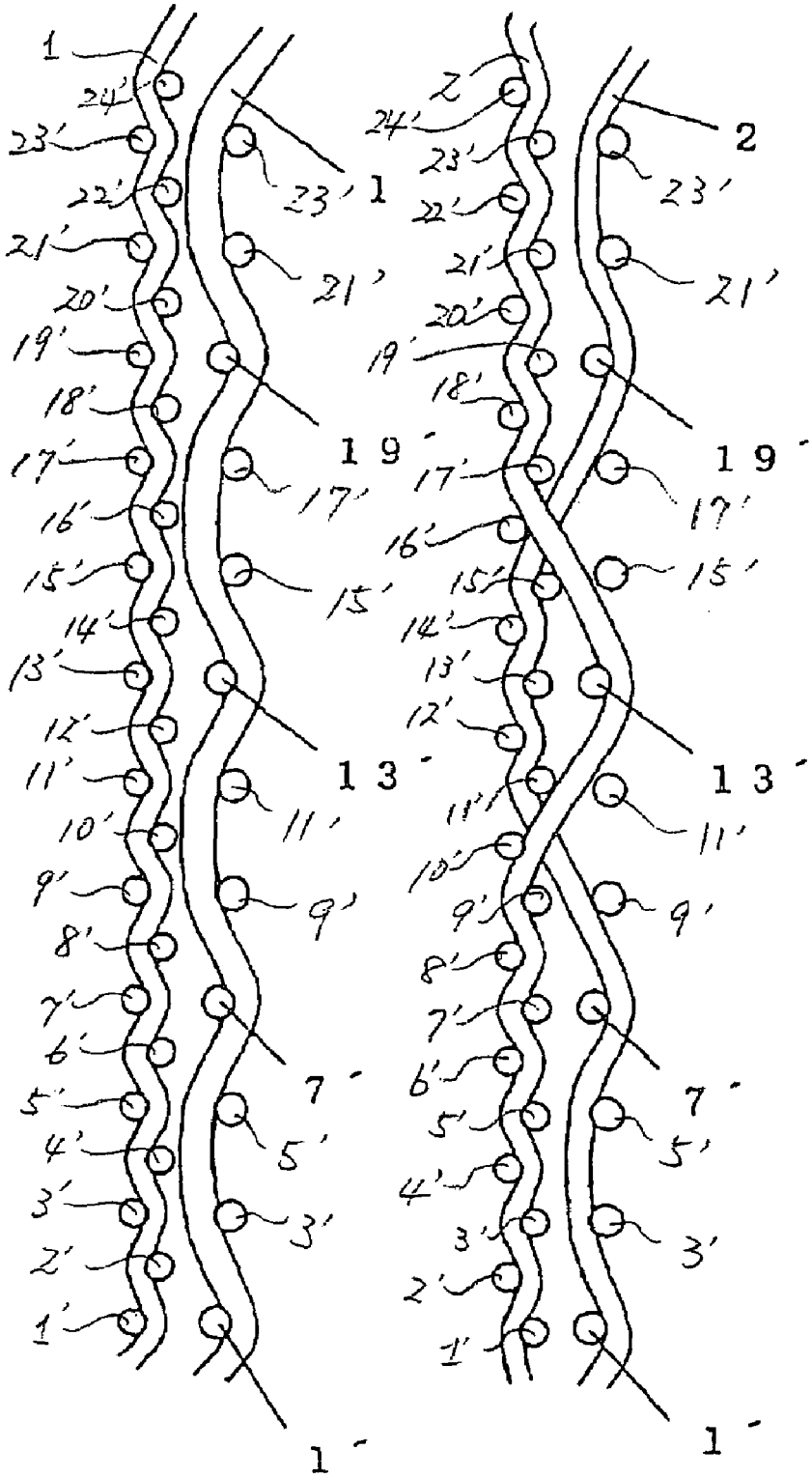
FIGS. 2A and 2B include cross-sectional views along line IIA—IIA at a pair of an upper surface side warp 1 and a lower surface side warp 1, and along line IIB—IIB at a pair of warp binding yarns 2, each illustrated in FIG. 1.
Figure 3:
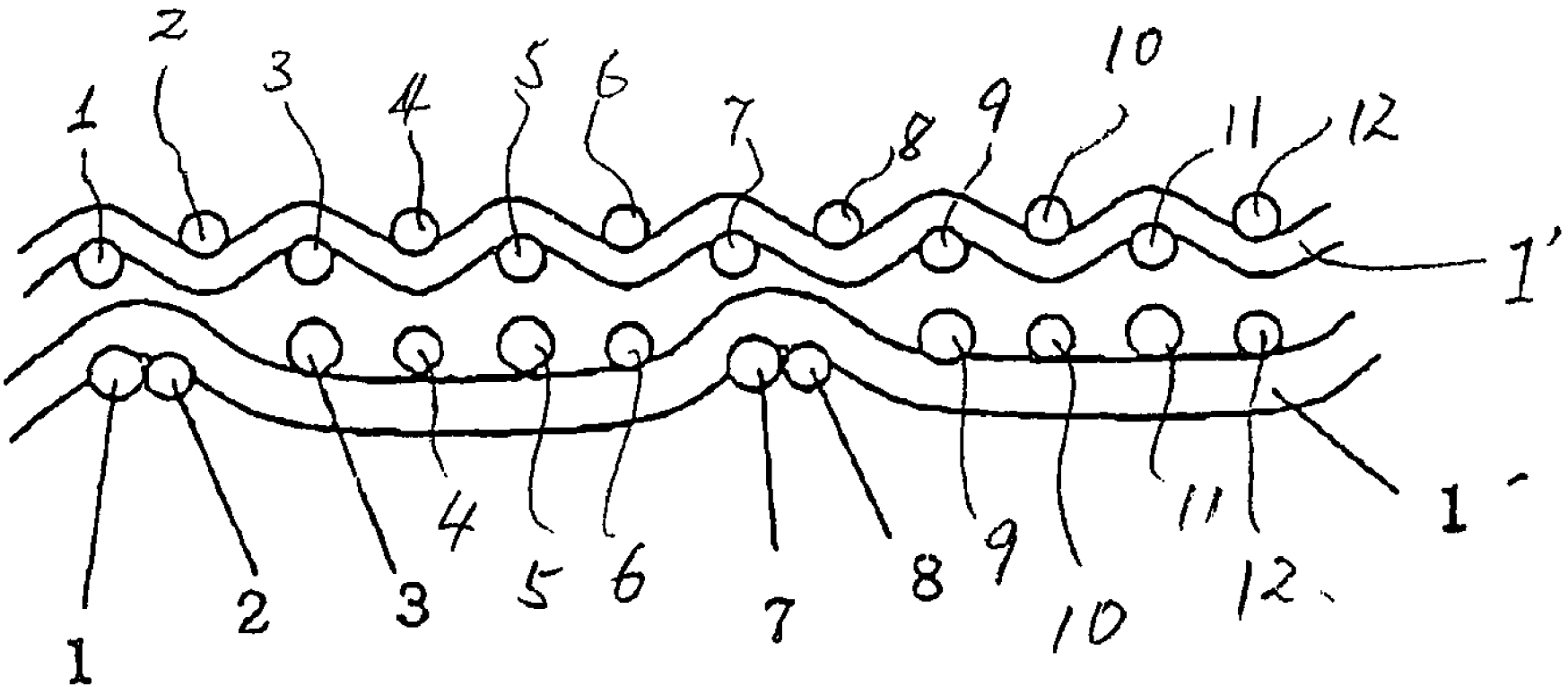
FIG. 3 is a cross-sectional view along the line III—III at a weft 1' of FIG. 1.
Figure 4:
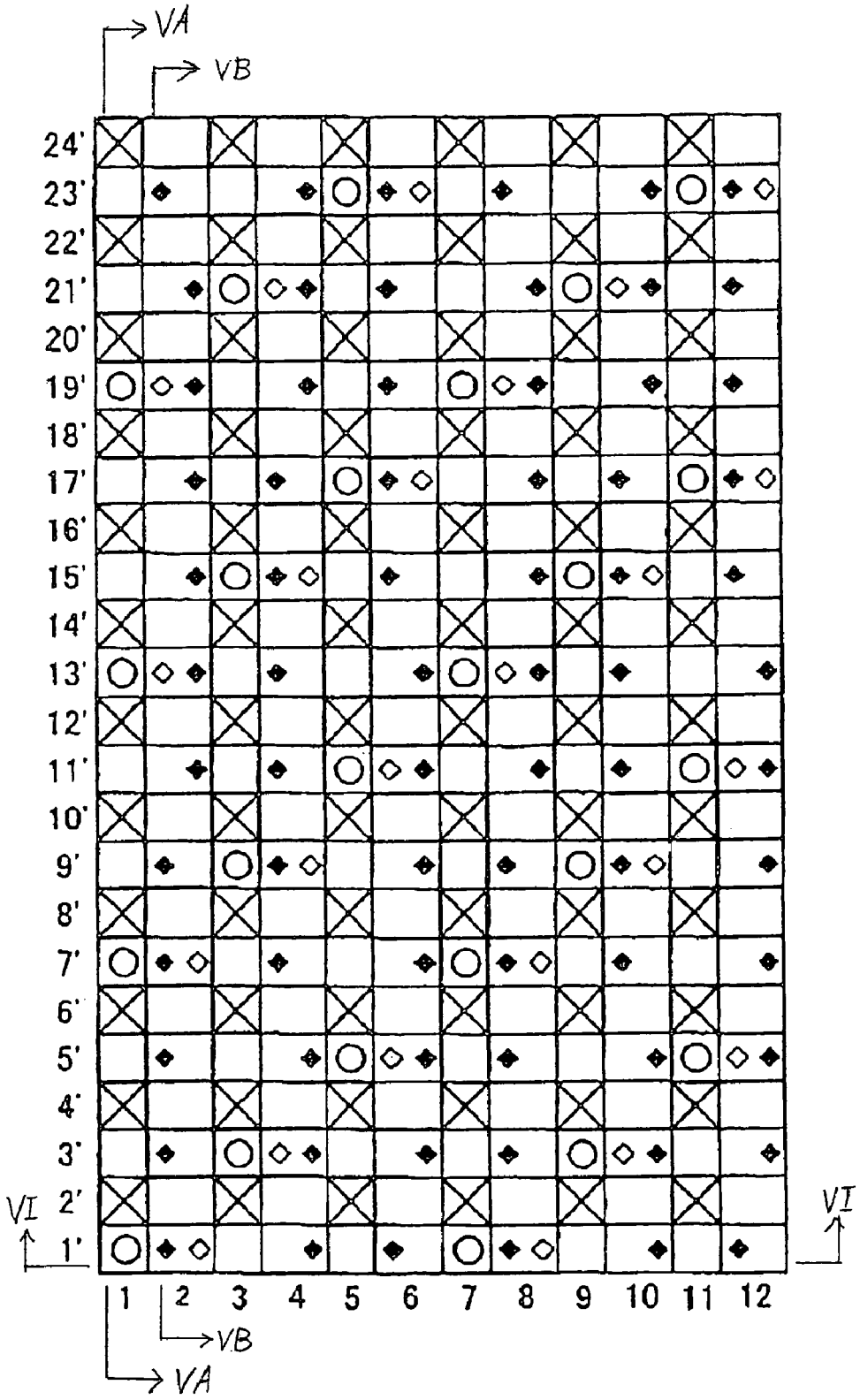
FIG. 4 is a design diagram of an industrial two-layer fabric according to Example 2 of the present invention.
Figures 5A, 5B:
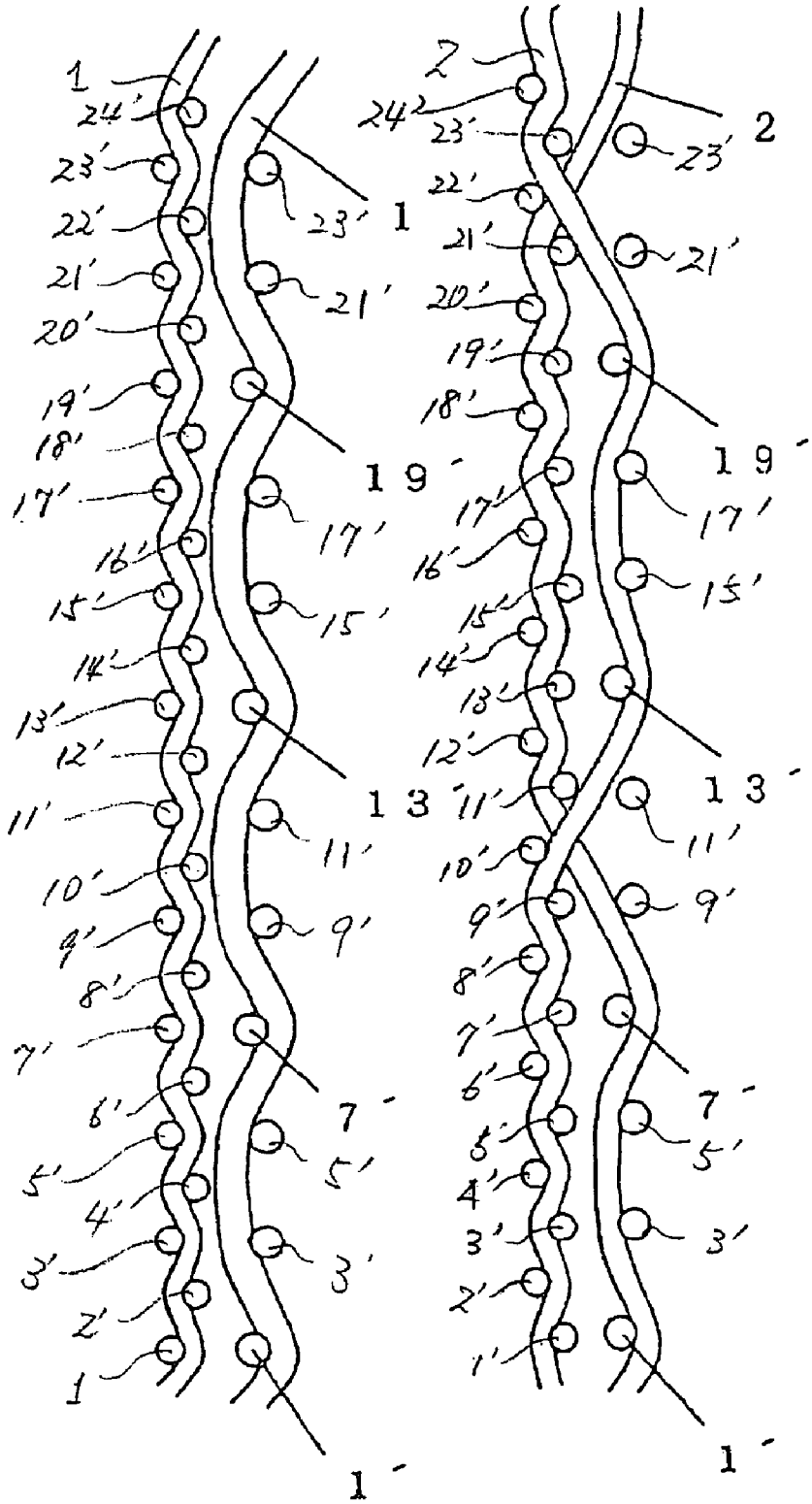
FIGS. 5A and 5B include cross-sectional views along the line VA—VA at a pair of an upper surface side warp 1 and a lower surface side warp 1, and along the line VB—VB at a pair of warp binding yarns 2, each illustrated in FIG. 4.
Figure 6:
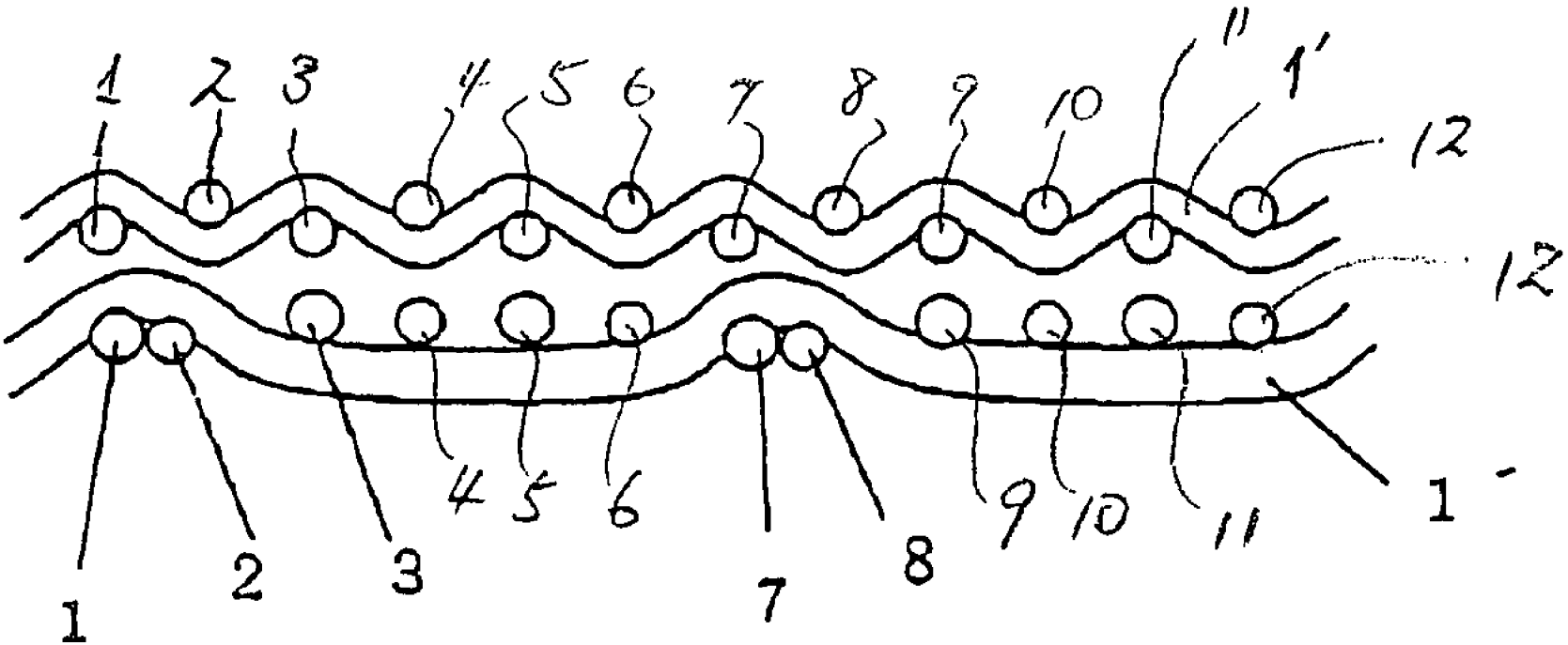
FIG. 6 is a cross-sectional view along the line VI—VI at a weft 1' of FIG. 4.
Figure 7:
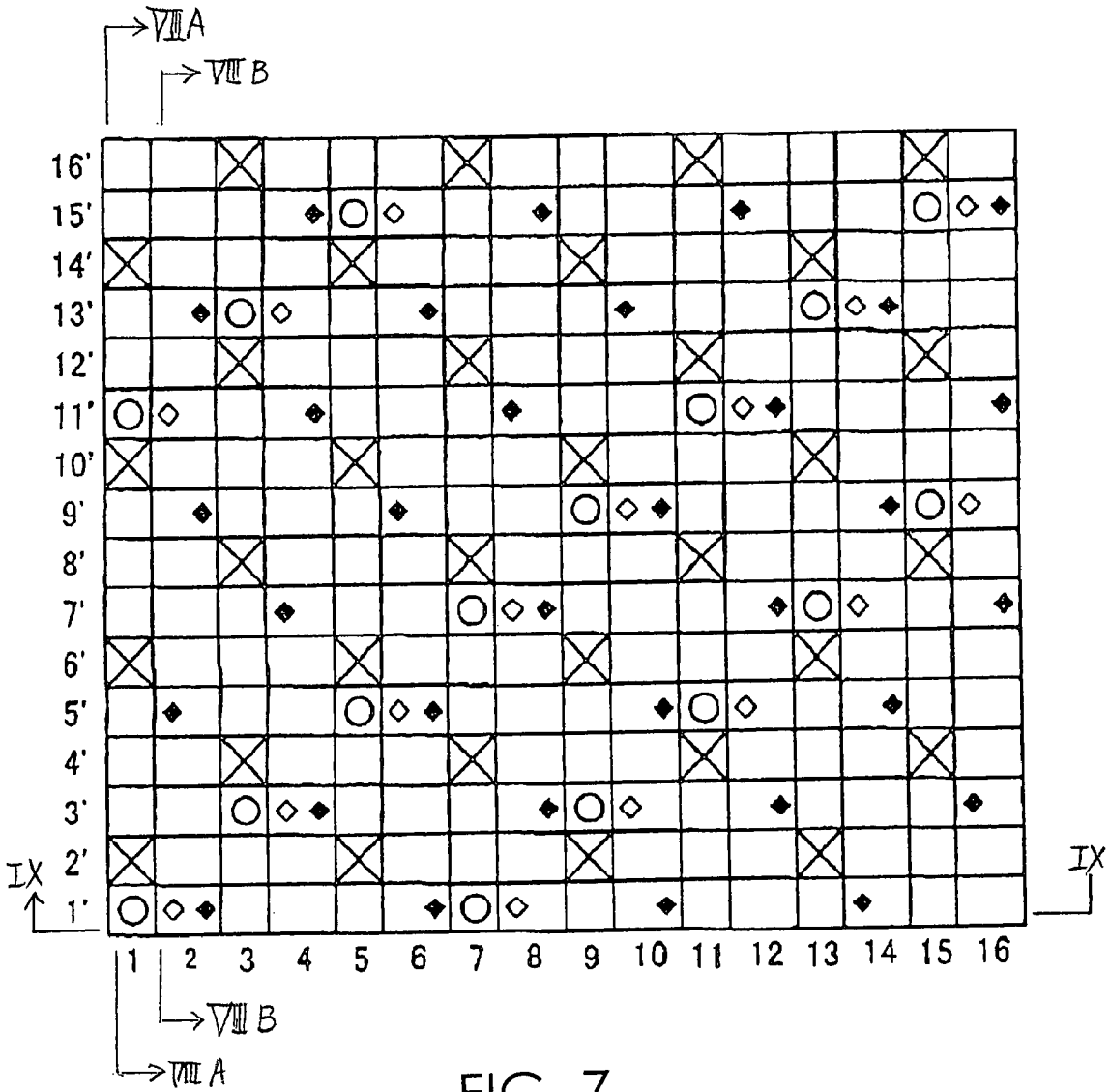
FIG. 7 is a design diagram of an industrial two-layer fabric obtained in Example 3 of the present invention.
Figures 8A, 8B:
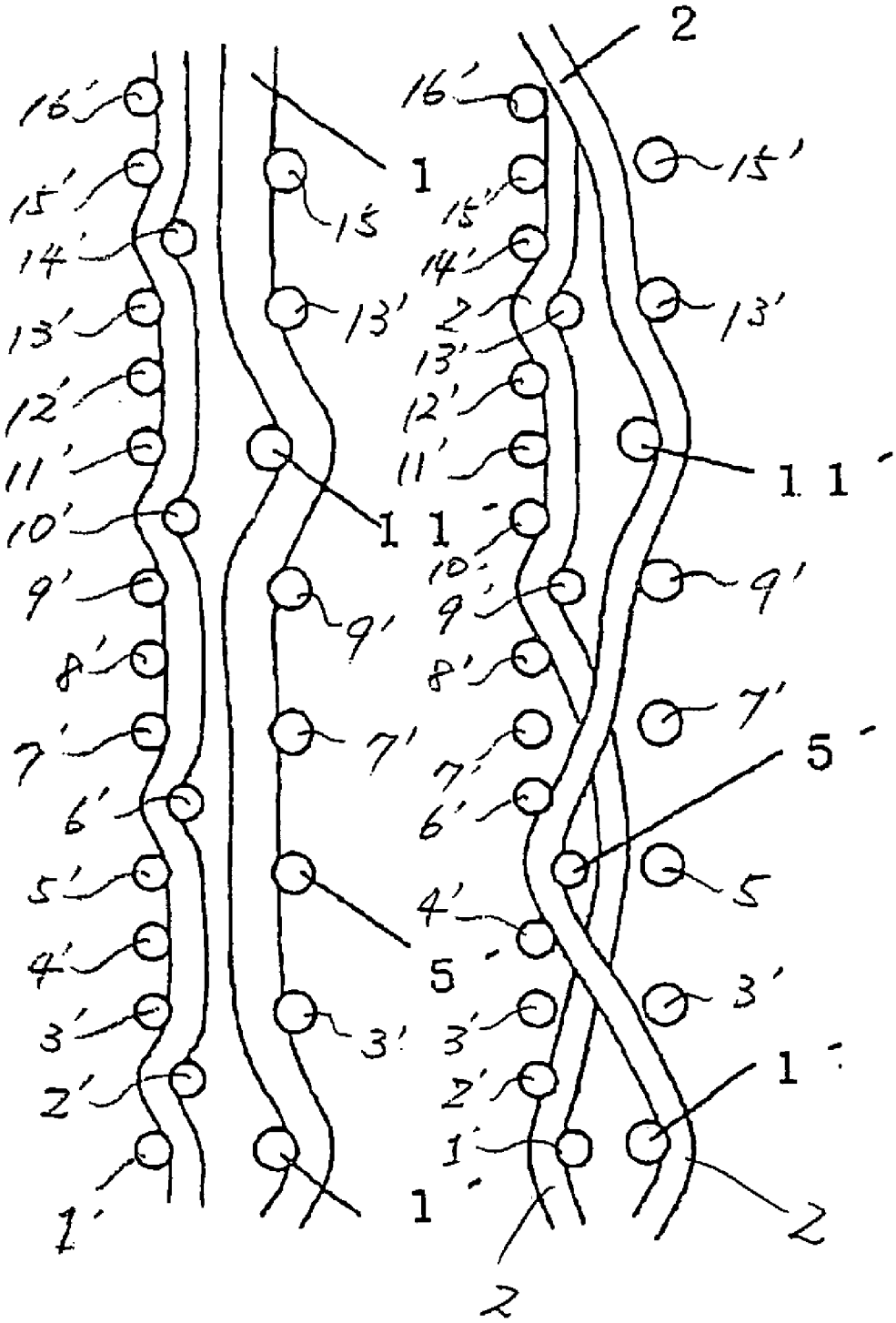
FIGS. 8A and 8B include cross-sectional views along the line VIIIA—VIIIA at a pair of an upper surface side warp 1 and a lower surface side warp 1, and a pair of a warp binding yarn 2 and along the line VIIIB—VIIIB at an upper surface side warp 2, each illustrated in FIG. 7.
Figure 9:
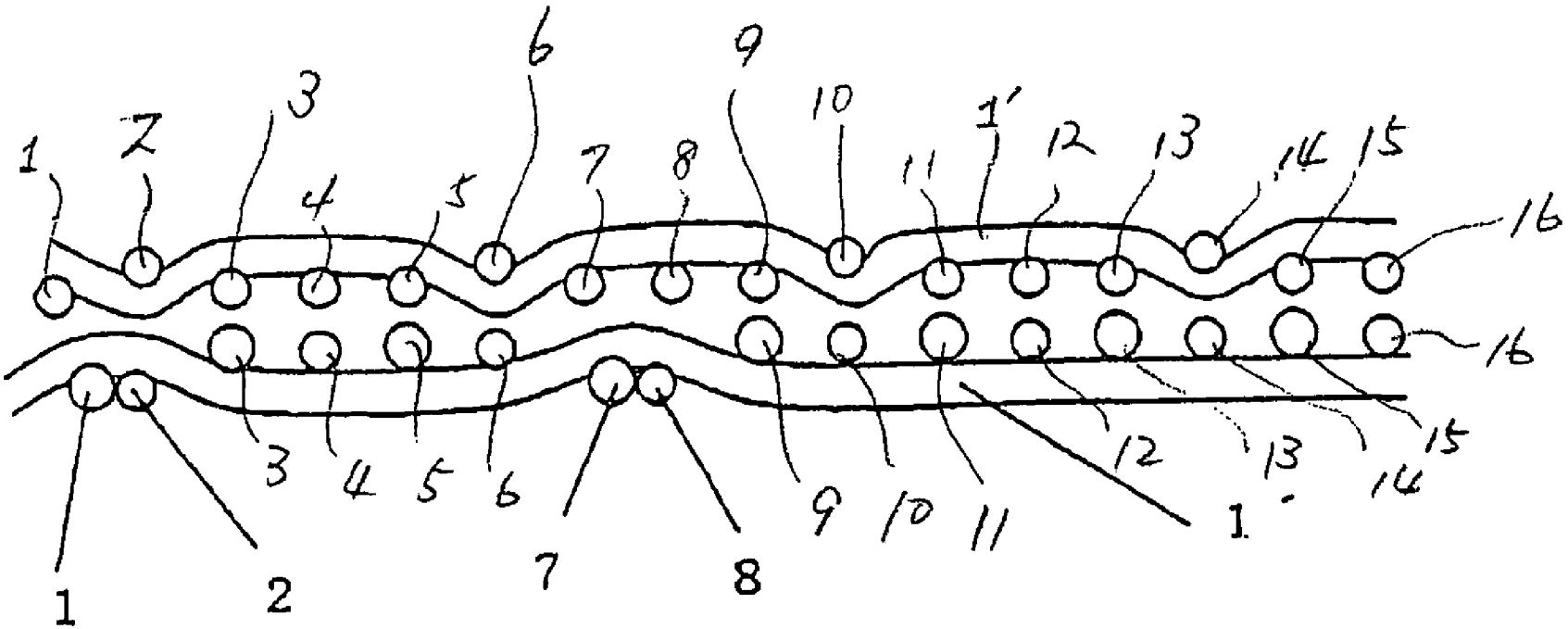
FIG. 9 is a cross-sectional view along a line IX—IX at weft 1' of FIG. 7.

FIGS. 1, 4 and 7 are design diagrams illustrating the complete designs of the examples of the present invention. The term "complete design" means a minimum repeating unit of a weave pattern and a whole design of the fabric is formed by vertical and horizontal connection of a plurality of these complete designs. FIGS. 2A and 2B include a cross-sectional view along the line IIA—IIA at a pair of an upper surface side warp 1 and a lower surface side warp 1 and a cross-sectional view along line the IIB—IIB at a pair of warp binding yarns 2, each of the fabric of FIG. 1. FIG. 3 is a cross-sectional view of the fabric of FIG. 1 along the line III—III at a weft 1'. FIGS. 5A and 5B includes a cross-sectional view along the line VA—VA at a pair of an upper surface side warp 1 and a lower surface side warp 1 and a cross-sectional view along the line VB—VB at a pair of warp binding yarns 2, each of the fabric of FIG. 4. FIG. 6 is a cross-sectional view of the fabric of FIG. 4 along the line VI-VI at the weft 1'. FIGS. 8A and 8B include a cross-sectional view along the line VIIIA—VIIIA at a pair of an upper surface side warp 1 and a lower surface side warp 1 and a cross-sectional view along the line VIIIB—VIIIB at a pair of warp binding yarns, each of the fabric of FIG. 7. FIG. 9 is a cross-sectional view of the fabric of FIG. 7 along the line IX—IX at the weft 1'.

FIG. 1 illustrates the paired warp binding yarns which have different designs. FIG. 4 illustrates the paired warp binding yarns which have the same design. In FIG. 4, the upper surface side warp and warp binding yarn are paired.

In the design diagrams, warps are indicated by Arabic numerals, for example 1, 2 and 3, in which odd numbers 1, 3, 5 and the like indicate pairs of an upper surface side warp and a lower surface side warp arranged vertically and even numbers 2, 4, 6 and the like indicate a pair of warp binding yarns, or a pair of an upper surface side warp and a warp binding yarn. Wefts are indicated by Arabic numerals with a prime, for example, 1', 2' and 3'.

In the diagram, a cross "x" means that an upper surface side warp lies over an upper surface side weft, an open circle "○" indicates that a lower surface side warp lies under a lower surface side weft, a solid square "◆" indicates that a warp binding yarn and an upper surface side war forming a pair with a warp binding yarn lie over an upper surface side weft, and an open square "◇" indicates that a warp binding yarn lies under a running surface side weft.

The upper surface side warp and lower surface side warp, and upper surface side weft and lower surface side weft are vertically overlapped each other. The design diagram shows, for convenience of drawing, that these warps or wefts are overlapped without deviation. Deviation is however allowed in the actual fabric. In the diagram, two warp binding yarns or an upper surface side warp and a warp binding yarn, each forming a pair, are separated, but they are not separated really and function as one warp constituting an upper surface side complete design on the upper surface side surface. This also applies to the lower surface side layer.

Example 1

In the design diagram of FIG. 1, numerals 1, 3, 5 . . . 11 indicate pairs of an upper surface side warp and a lower surface side warp arranged vertically; numerals 2, 4, 6 . . . 12 indicate pairs of two warp binding yarns and the pairs of warps and the pairs of warp binding yarns are arranged alternately; numerals with a prime 1', 2', 3' . . . 24' are upper surface side wefts and lower surface side wefts and no lower surface side wefts are arranged at even numbers.

The fabric was formed using upper surface side warps and warp binding yarns, each having a diameter of 0.13 mm, lower surface side warps having a diameter of 0.20 mm, upper surface side wefts having a diameter of 0.13 mm and lower surface side wefts having a diameter of 0.25 mm. In this Example, the diameter of the upper surface side wefts is made equal to that of the upper surface side warps, but they may be different. No limitation is imposed on the diameter insofar as the upper surface side warps and warp binding yarns are of the same diameter and the lower surface side warps have a diameter greater than that.

The upper surface side warps are woven with the upper surface side wefts alternately, thereby forming a plain weave design over the upper surface side surface. Although two warp binding yarns used in a pair have a different design, they appear from the upper surface side surface alternately, cooperatively function as one warp and form a plain weave design similar to that of the upper surface side warp. Designs formed by the pair of an upper surface side warp and a warp binding yarn on the upper surface side surface are the same, but they may be different. Or, they may be a plurality of warp complete designs on the upper surface side. It is however possible to obtain a uniform upper surface side surface by using upper surface side warps and warp binding yarns equal in diameter and the same warp design.

When one of the warp binding yarns is woven with the upper surface side weft to form an upper surface side design, the other warp binding yarn is woven with the lower surface side weft to form a lower surface side design. In other words, in a portion where one of the warp binding yarns forms the lower surface side surface design, the other warp binding yarn forms the upper surface side surface design and in a portion where one of the warp binding yarns forms an upper surface side surface design, the other warp binding yarn forms the upper surface side surface design. These two warp binding yarns complement the designs mutually, thereby forming the upper surface side surface design and lower surface side surface design. The warp binding yarns used in pairs in this example have different designs, but they may have the same design.

The lower surface side layer is designed so that a lower surface side warp and a warp binding yarn are arranged alternately; and a lower surface side weft passes over a lower surface side warp and a warp binding yarn adjacent to each other, and then passes under a plurality of lower surface side warps and warp binding yarns. In a portion where a warp binding yarn passes under a lower surface side weft and weaves the lower surface side weft therein, an upper surface side warp of a larger diameter which is always adjacent to the warp binding yarn also weaves the lower surface side weft therein so that the warp binding yarn of a relatively small diameter does not protrude from the lower surface side surface compared with the lower surface side warp, which contributes to prevent the abrasion of the warp binding yarn. As a result, the resulting fabric acquires not only surface property and wear resistance but also various physical properties necessary for industrial fabrics such as rigidity, fiber supporting property and running stability. As can be seen from FIG. 3, in this Example 1, a running surface side weft 1' passes over a lower surface side warp 1 and a warp binding yarn 2, passes under a lower surface side warp 3, a warp binding yarn 4, a lower surface side warp 5 and a warp binding yarn 6, passes over a lower surface side warp 7 and a warp binding yarn 8, and then passes under a lower surface side warp 9, a warp binding yarn 10, a lower surface side warp 11 and a warp binding yarn 12. It is needless to say that the warp binding yarns 2 and 8 of a smaller diameter do not wear prior to the lower surface side warp, because they do not protrude from the lower surface side surface compared with the lower surface side warp 7.

Example 2

The fabric as illustrated in FIG. 4 is arranged similar to that of FIG. 1 but is different in the design of warp binding yarns. In Example 1, the warp binding yarns used in a pair have different patterns, while in this Example, the warp binding yarns used in a pair have the same pattern. The design formed on the upper surface side surface and the design formed on the lower surface side surface are similar to those of Example 1. It is thus possible to form an upper surface side complete design and a lower surface side complete design, each similar to that of Example 1, even if the design of the warp binding yarns is changed. Also in this Example, below a portion in which one of warp binding yarns is woven with an upper surface side weft to form an upper surface side surface design, the other warp binding yarn is woven with a lower surface side weft to form a lower surface side surface design. Above a portion in which one of warp binding yarns is woven with a lower surface side weft to form the lower surface side surface design, the other warp binding yarn is woven with an upper surface side weft to form the upper surface side surface design. In such a manner, two warp binding yarns complement the designs mutually, thereby forming a warp complete design forming the upper surface side surface design and a warp complete design forming the lower surface side surface design.

The lower surface side layer is designed so that a lower surface side warp and a warp binding yarn are arranged alternately; and a lower surface side weft passes over a lower surface side warp and a warp binding yarn adjacent to each other, and then passes under a plurality of lower surface side warps and warp binding yarns. In a portion where a warp binding yarn passes under a lower surface side weft and weaves the lower surface side weft therein, a lower surface side warp of a larger diameter which is always adjacent to the warp binding yarn also weaves the lower surface side weft therein so that the warp binding yarn of a relatively small diameter does not protrude from the lower surface side surface. The warp binding yarn is therefore resistant to wear. As a result, the resulting fabric acquires not only surface property and wear resistance, but also various physical properties necessary for industrial fabrics such as rigidity, fiber supporting property and running stability.

Example 3

In FIG. 7, a pair of an upper surface side warp and a warp binding yarn is arranged adjacent to a pair of an upper surface side warp and a lower surface side warp. The warp binding yarn is woven with both an upper surface side weft and a lower surface side weft, while the upper surface side warp forming a pair with the warp binding yarn is woven only with the upper surface side weft. The warp binding yarn and upper surface side warp forming the pair cooperatively function as one warp constituting an upper surface side complete design. For example, a pair of a warp binding yarn 2 and an upper surface side warp 2 as illustrated in FIG. 8 is designed so that the warp binding yarn 2 passes under a lower surface side weft 1', passes over an upper surface side weft 5', and passes under a lower surface side weft 11'. The upper surface side warp 2 passes over an upper surface side weft 1', passes under upper surface side wefts 2' to 8', passes over an upper surface side weft 9', passes under upper surface side wefts 10' to 12', passes over an upper surface side weft 13' and then passes under upper surface side wefts 14' to 16'. In a portion where the warp binding yarn 2 is woven by the upper surface side weft 5', the upper surface side warp 2 does not appear from the upper surface side surface and these two yarns cooperatively form the upper surface side surface design corresponding to one warp.

The lower surface side layer is designed so that a lower surface side warp and a warp binding yarn are arranged alternately; and a lower surface side weft passes over a lower surface side warp and a warp binding yarn adjacent to each other, and then passes under a plurality of lower surface side warps and warp binding yarns. In a portion where a warp binding yarn passes under the lower surface side weft and weaves the lower surface side weft therein, a lower surface side warp of a larger diameter which is always adjacent to the warp binding yarn weaves the lower surface side weft therein so that a warp binding yarn of a relatively small diameter does not protrude from the lower surface side surface. The warp binding yarn is therefore resistant to wear. As a result, the resulting fabric acquires not only surface property and wear resistance but also various physical properties necessary for industrial fabrics such as rigidity, fiber supporting property and running stability.

The fabric according to the present invention has excellent surface property, binding power, rigidity and wear resistance so that it can be suited for use for a prolonged period.

Although only some exemplary embodiments of this invention have been described in detail above, those skilled in the art will readily appreciated that many modifications are possible in the exemplary embodiments without materially departing from the novel teachings and advantages of this invention. Accordingly, all such modifications are intended to be included within the scope of this invention.

The disclosure of Japanese Patent Application No. 2004-242240 filed Aug. 23, 2004 including specification, drawings and claims is incorporated herein by reference in its entirety.

What is claimed is:

1. An industrial two-layer fabric comprising pairs of an upper surface side warp and a lower surface side warp arranged vertically, and warp binding yarns woven with upper surface side wefts and lower surface side wefts to form a portion of an upper surface side surface design and a portion of a lower surface side surface design, wherein:

upper surface side warps and warp binding yarns are of the same diameter and lower surface side warps have a greater diameter than warp binding yarns and upper surface side warps; and a lower surface side layer is designed so that lower surface side warps and warp binding yarns are arranged alternately, and one lower surface side weft passes over one lower surface side warp and one warp binding yarn adjacent to each other, and passes under a plurality of lower surface side warps and warp binding yarns.

2. The industrial two-layer fabric according to claim 1, wherein a pair of warp binding yarns is arranged adjacent to the pair of an upper surface side warp and a lower surface side warp arranged vertically, and on the upper surface side surface, the warp binding yarns as a pair are woven with respective upper surface side wefts and cooperatively function as one warp constituting the upper surface side complete design.

3. The industrial two-layer fabric according to claim 1, wherein a pair of an upper surface side warp and a warp binding yarn is arranged adjacent to the pair of an upper surface side warp and a lower surface side warp arranged vertically, and on the upper surface side surface, the upper surface side warp and warp binding yarn as a pair are woven with respective upper surface side wefts and cooperatively function as one warp constituting the upper surface side complete design.

4. The industrial two-layer fabric, wherein in the pair of warp binding yarns as claimed in claim 2, one warp binding yarn passes over at least one upper surface side weft to form the upper surface side surface, below which the other warp binding yarn is woven with at least one lower surface side weft, and at the same time, one warp binding yarn is woven with at least one lower surface side weft, over which the other warp binding yarn passes over at least one upper surface side weft to form the upper surface side surface; and the pair of warp binding yarns mutually complements the upper surface side surface design and lower surface side surface design one another and functions as one warp constituting the upper surface side complete design on the upper surface side and as one warp constituting the lower surface side complete design on the lower surface side.

5. The industrial two-layer fabric according to claim 1, wherein the upper surface side complete design is composed of one warp complete design.

6. The industrial two-layer fabric according to claim 1, wherein the upper surface side complete design is composed of at least two warp complete designs.

7. The industrial two-layer fabric according to claim 1, wherein the upper surface side surface design is any one of 2-shaft plain weave, 4-shaft twill weave, 4-shaft broken twill weave, 8-shaft twill weave and 8-shaft broken twill weave.

8. An industrial two-layer fabric according to claim 1, wherein the number of upper surface side wefts is 1 to 2 times the number of lower surface side wefts.

* * * * *